US008523653B2

(12) United States Patent
Lind et al.

(10) Patent No.: US 8,523,653 B2
(45) **Date of Patent: *Sep. 3, 2013**

(54) METHOD, APPARATUS, AND PROGRAM PRODUCT FOR PRESENTING RESULTS IN A BINGO-TYPE GAME

(75) Inventors: Clifton Lind, Austin, TX (US); Gordon T. Graves, Austin, TX (US); Gary L. Loebig, Austin, TX (US); Jefferson C. Lind, Austin, TX (US); Joseph R. Enzminger, Austin, TX (US); Rodney L. Willyard, Flower Mound, TX (US); Robert Lannert, Broken Arrow, OK (US)

(73) Assignee: Multimedia Games, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,811

(22) Filed: Apr. 2, 2012

(65) Prior Publication Data

US 2012/0190422 A1 Jul. 26, 2012

Related U.S. Application Data

(63) Continuation of application No. 11/929,011, filed on Oct. 30, 2007, now Pat. No. 8,147,314, which is a continuation of application No. 10/060,643, filed on Jan. 30, 2002, now Pat. No. 7,766,741, which is a continuation of application No. 10/028,889, filed on Dec. 20, 2001, now Pat. No. 6,802,776.

(60) Provisional application No. 60/265,100, filed on Jan. 30, 2001.

(51) Int. Cl.
*A63F 9/24* (2006.01)

(52) U.S. Cl.
USPC ..... 463/19

(58) Field of Classification Search
USPC ..... 463/19
See application file for complete search history.

(56) References Cited

U.S. PATENT DOCUMENTS

| | | | |
|---|---|---|---|
| 4,140,320 | A | 2/1979 | Cortimilia |
| 4,373,726 | A | 2/1983 | Churchill et al. |
| 4,494,197 | A | 1/1985 | Troy et al. |
| 4,652,998 | A | 3/1987 | Koza et al. |

(Continued)

FOREIGN PATENT DOCUMENTS

| | | |
|---|---|---|
| EP | 0 867 209 A1 | 9/1998 |
| GB | 2 147 773 A | 5/1985 |

OTHER PUBLICATIONS

Bingo King Catalog, 1996-1997, No. 295 (6 pages).

(Continued)

*Primary Examiner* — Corbett B Coburn
(74) *Attorney, Agent, or Firm* — Russell D. Culbertson, Esq.; JP Cody, Esq.

(57) ABSTRACT

A result represented by a matched bingo card representation is displayed to a player in a bingo-type game through a result representation provided at a suitable player station. Each result representation includes a graphical representation unrelated to the bingo-type game. That is, although the game results are simply bingo game results defined by predetermined patterns of matches between the various card designations and the designation set produced or called for a particular bingo-type game, the game results are displayed to the players with a graphical display including a graphic that is not merely a graphical representation or reproduction of a bingo card.

12 Claims, 12 Drawing Sheets

(56) References Cited

U.S. PATENT DOCUMENTS

| | | | |
|---|---|---|---|
| 4,760,527 | A | 7/1988 | Sidley |
| 4,856,787 | A | 8/1989 | Itkis |
| 4,909,516 | A | 3/1990 | Kolinsky |
| 4,926,327 | A | 5/1990 | Sidley |
| 5,193,815 | A | 3/1993 | Pollard |
| 5,265,874 | A | 11/1993 | Dickinson et al. |
| 5,265,880 | A | 11/1993 | Maksymec |
| 5,297,802 | A | 3/1994 | Pocock et al. |
| 5,324,035 | A | 6/1994 | Morris et al. |
| 5,393,057 | A | 2/1995 | Marnell, II |
| 5,487,544 | A | 1/1996 | Clapper, Jr. |
| 5,518,253 | A | 5/1996 | Pocock et al. |
| 5,536,008 | A | 7/1996 | Clapper, Jr. |
| 5,544,881 | A | 8/1996 | Rua, Jr. et al. |
| 5,569,083 | A | 10/1996 | Fioretti |
| 5,580,311 | A | 12/1996 | Haste, III |
| 5,586,937 | A | 12/1996 | Menashe |
| 5,588,913 | A | 12/1996 | Hecht |
| 5,595,538 | A | 1/1997 | Haste, III |
| 5,609,337 | A | 3/1997 | Clapper, Jr. |
| 5,611,729 | A | 3/1997 | Schumacher et al. |
| 5,645,485 | A | 7/1997 | Clapper, Jr. |
| 5,674,128 | A | 10/1997 | Holch et al. |
| 5,679,077 | A | 10/1997 | Pocock et al. |
| 5,685,541 | A | 11/1997 | Lovell, Sr. |
| 5,704,835 | A | 1/1998 | Dietz, II |
| 5,709,603 | A | 1/1998 | Kaye |
| 5,749,784 | A | 5/1998 | Clapper, Jr. |
| 5,770,533 | A | 6/1998 | Franchi |
| 5,800,269 | A | 9/1998 | Holch et al. |
| 5,810,664 | A | 9/1998 | Clapper, Jr. |
| 5,833,540 | A | 11/1998 | Miodunski et al. |
| 5,857,911 | A | 1/1999 | Fioretti |
| 5,871,398 | A | 2/1999 | Schneier et al. |
| 5,928,082 | A | 7/1999 | Clapper, Jr. |
| 5,935,002 | A | 8/1999 | Falciglia |
| 5,941,771 | A | 8/1999 | Haste, III |
| 5,951,396 | A | 9/1999 | Tawil |
| 5,954,583 | A | 9/1999 | Green |
| 5,971,849 | A | 10/1999 | Falciglia |
| 5,980,385 | A | 11/1999 | Clapper, Jr. |
| 5,984,779 | A | 11/1999 | Bridgeman et al. |
| 6,024,640 | A | 2/2000 | Walker et al. |
| 6,056,289 | A | 5/2000 | Clapper, Jr. |
| 6,068,552 | A | 5/2000 | Walker et al. |
| 6,079,711 | A | 6/2000 | Wei et al. |
| 6,089,982 | A | 7/2000 | Holch et al. |
| 6,126,542 | A | 10/2000 | Fier |
| 6,186,892 | B1 | 2/2001 | Frank et al. |
| 6,203,427 | B1 | 3/2001 | Walker et al. |
| 6,227,972 | B1 | 5/2001 | Walker et al. |
| 6,244,957 | B1 | 6/2001 | Walker et al. |
| 6,273,820 | B1 | 8/2001 | Haste, III |
| 6,280,325 | B1 | 8/2001 | Fisk |
| 6,280,328 | B1 | 8/2001 | Holch et al. |
| 6,306,038 | B1 | 10/2001 | Graves et al. |
| 6,319,122 | B1 | 11/2001 | Packes, Jr. et al. |
| 6,322,446 | B1 | 11/2001 | Yacenda |
| 6,394,898 | B1 | 5/2002 | Nagao et al. |
| 6,428,413 | B1 | 8/2002 | Carlson |
| 6,581,935 | B1 | 6/2003 | Odom |
| 6,585,590 | B2 | 7/2003 | Malone |
| 6,743,102 | B1 | 6/2004 | Fiechter et al. |
| 6,780,108 | B1 | 8/2004 | Luciano, Jr. et al. |
| 6,899,622 | B2 | 5/2005 | Lind et al. |
| 2002/0082070 | A1 | 6/2002 | Macke et al. |
| 2002/0094860 | A1 | 7/2002 | Itkis et al. |
| 2002/0137562 | A1 | 9/2002 | Malone |
| 2003/0032480 | A1 | 2/2003 | Keith |

OTHER PUBLICATIONS

Curtis, Anthony, "Class Doesn't Matter: Understanding What Games Can and Can't Be Offered," Strictly Slots Magazine, retrieved on Feb. 3, 2006 from Internet: <http://www.strictlyslots.com/archive/0412ss/afaic.html> (3 pages).

Dvorchak, Mark E., "Class II Gaming: Not Second Class," Economics Research Associates, Nov. 2003, pp. 1-7, (11 pages).

"EverGreen and Tooty Frooty Bingo. Same Game, Two Names," Brochure, Dec. 1998 (2 pages).

National Indian Gaming Commision, Letter to Montgomery dated Nov. 2, 1999, re: opinion on Evergreen Bingo, printed Jul. 5, 2005, <http://www.nigc.gov/nigc/documents/opinions/evergreen.jsp> (3 pages).

Rose, I. Nelson, "Is It Bingo, or a Slot Machine?," Card Player Magazine, Jan. 31, 2003, vol. 16, No. 3, retrieved on Feb. 8, 2006 from the Internet: <http://www.cardplayer.com/poker_magazine/archives/printarticle.php?a_id=13062> (3 pages).

Rose, I. Nelson, "Tribes Given Chance to Open Class II Casinos," Casino City Times, Sep. 18, 2000, retrieved on Feb. 8, 2006 from the Internet: <http://rose.casinocitytimes.com/articles/993.html> (4 pages).

United States v. 103 Electronic Gambling Devices, 223 F.3d 1091, 9th Circuit 2000 (20 pages).

United States v. 162 Megamania Gambling Devices, 231 F.3d 713, 10th Circuit 2000 (14 pages).

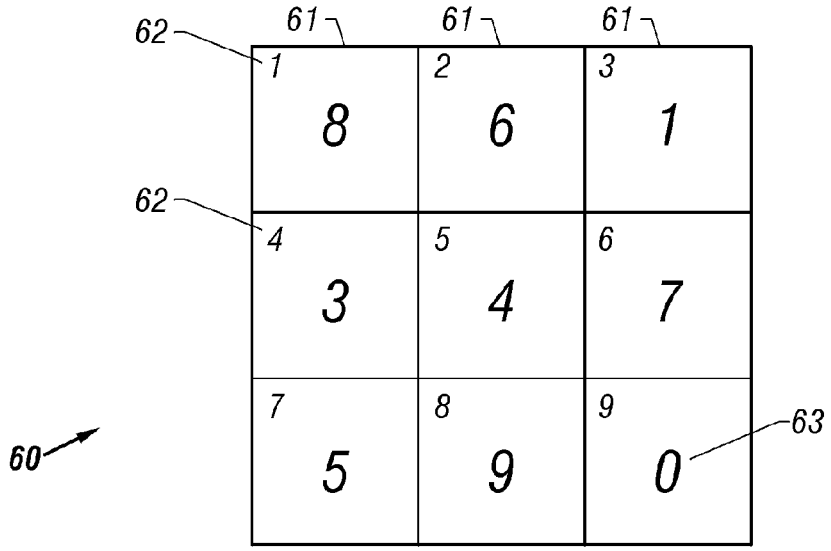

FIG. 5

PRIZE SCHEDULE (Prizes are in credits per credit wagered)

| Prize | Pattern | Odds (to 1) | Prize (credits) | Allocation |
|---|---|---|---|---|
| Super Jackpot* | Any 2 Row | 333,333 | 20000 | 6.00% |
| Jackpot | Middle Row | 1,000 | 100 | 10.00% |
| Must Go | Top or Bottom Row | 500 | 25 | 5.00% |
| Consolation | Column or Diagonal | 200 | 10 | 5.00% |
| Churn | Any 2 Adjacent Spots | 5 | 3 | 60.00% |
| Allocation to "Max Bet" Super Jackpot Progressive: | | | | 4.00% |
| | | | Total Prize Allocation: | 90.00% |

Note 1: 4% of all wagers is allocated to growth of the "Max Bet" Super Jackpot
Note 2: Average number of cards to end game: 333,33

FIG. 6

METHOD, APPARATUS, AND PROGRAM PRODUCT FOR PRESENTING RESULTS IN A BINGO-TYPE GAME

CROSS-REFERENCE TO RELATED APPLICATIONS

This application is a continuation of U.S. patent application Ser. No. 11/929,011 filed Oct. 30, 2007 now U.S. Pat. No. 8,147,314, and entitled "Method, Apparatus, and Program Product for Presenting Results in a Bingo-Type Game," which is a continuation of U.S. patent application Ser. No. 10/060,643 filed Jan. 30, 2002, and entitled "Method, Apparatus, and Program Product for Presenting Results in a Bingo-Type Game," now U.S. Pat. No. 7,766,741, which is a continuation of the U.S. patent application Ser. No. 10/028,889 filed Dec. 20, 2001, and entitled "Method and Program Product for Producing and Using Game Play Records in a Bingo-Type Game," now U.S. Pat. No. 6,802,776, which claims the benefit of U.S. Provisional Patent Application Ser. No. 60/265,100 filed Jan. 30, 2001, and entitled "Object Draw Gaming System and Program Product." The Applicants claim the benefit of the above-identified non-provisional patent applications under 35 U.S.C. §120, and claim the benefit of the provisional application under 35 U.S.C. §119(e). The entire content of each of these applications is incorporated herein by this reference.

TECHNICAL FIELD OF THE INVENTION

This invention relates to gaming and gaming systems. More particularly, the invention relates to a bingo-type gaming system in which a set of bingo card representations is matched with bingo designations to produce bingo results that are displayed to players using a representation unrelated to the bingo-type game. The invention encompasses a gaming method and apparatus, as well as a program product for implementing the gaming method.

BACKGROUND OF THE INVENTION

Bingo-type games are played with predefined bingo cards that each include a number of bingo game designations such as Arabic numerals randomly arranged in a desired manner, commonly in a grid. The bingo game designations on the cards are selected from a pool of available game designations. In more traditional bingo-type games, the cards are physically printed on paper or other suitable material. These printed cards are purchased by players prior to the start of a game. Once all the cards for a game have been purchased, game designations from the available pool of game designations are selected at random. As the game designations are selected and announced in the game, the players match the randomly selected game designations with the designations printed on their respective card or cards. This matching and marking of matched designations on the bingo card is commonly referred to as "daubing" the card. The player first producing a predetermined pattern of matches between the randomly selected game designations and the printed card designations is considered the winner. Consolation prizes may be awarded to players having cards matched to produce consolation prize patterns at the time of the winning pattern.

There are numerous variations on the traditional bingo game. Some bingo-type games perform a draw to produce a set of game designations prior to the sale of printed bingo cards. These bingo-type games use printed cards like regular printed bingo cards, but with the card face concealed in some fashion. Once a player purchases one of these covered face bingo cards, the player can match the drawn designations to the printed card designations to determine if the matched designations produce some predetermined winning pattern. The first player to redeem a card with the winning pattern ends the game.

Another variation of the traditional bingo game is played with electronic bingo card representations rather than the traditional printed bingo cards. In these bingo-type games, each bingo card is represented by a data structure that defines the various card locations and designations associated with the locations. This bingo-type game is played through player stations connected via a communications network to a central or host computer system. The central computer system is responsible for storing the bingo card representations and distributing or communicating bingo card representations to players at the player stations. The player stations display the bingo cards defined by the card representations and also allow the players to daub or mark designation matches as game designations are announced in the game. A primary advantage of this electronic bingo game is that the games may be played at a much faster pace than is practical with traditional paper bingo. Another advantage of this electronic version of bingo is that the games can be administered and controlled from a remote location and actually played at a number of different bingo establishments.

Traditional bingo games, either played with paper cards or electronic card representations are limited in the manner in which the results of a game may be displayed. It is also desirable to further increase the speed at which bingo-type games may be played. Yet it is essential that the game retain the basic characteristics of a bingo-type game, namely that the game is played with predefined cards or card representations which the players match or daub against randomly generated game designations, and the game winner is the first player to match the designations in a predetermined winning pattern on his or her card or card representation.

SUMMARY OF THE INVENTION

A gaming method embodying the principles of the invention is played with bingo card representations each stored as a data structure or data record defining a predefined arrangement of game designations chosen from a pool of available designations. The game designations associated with a given bingo card representation may be referred to as card designations. Game results (bingo game results), that is, winning and losing bingo card representations for a particular game are determined by matching the card designations to a game designation set produced for that game. A card representation having designations that match designations from the given game designation set in a predetermined game ending pattern represents a game ending result and is considered a winning card for the given game designation set. Card representations having designations that match the given set of game designations in other predetermined patterns before the game ending pattern is achieved are also considered winning cards and are awarded other prizes.

Each bingo card representation matched with a game designation set in a given bingo game may be referred to as a matched bingo card representation and represents a respective game play record providing a result in the bingo game. The result represented by a matched bingo card representation is displayed to a player in the bingo-type game through a result representation provided at a suitable player station. Each result representation is correlated to one or more game results in the bingo-type game so that each game result in the bingo-type game is associated with a result representation. According to the invention, each result representation includes a graphical representation unrelated to the bingo-type game. That is, although the game results are simply bingo game results defined by predetermined patterns of matches between the various card designations and the designation set produced or called for a particular bingo-type game, the game results are displayed to the players with a graphical display including a graphic that is not merely a graphical representation or reproduction of a bingo card. Displaying the result of the bingo-type game to the player thus involves displaying the result representation associated with the particular game result in lieu or at least in addition to the representation of the matched bingo-type game card.

In one preferred form of the invention the graphical representation unrelated to the underlying bingo-type game comprises a representation related to a casino game. For example, the game result in the bingo game may be displayed on an electronic display device to imitate a reel-type game or slot machine. Alternatively to a display imitating a reel-type game, the graphical representation unrelated to the underlying bingo-type game may comprise a representation imitating a card game such as poker or blackjack, roulette, craps, keno, or a competition such as a horse or dog race. In each of these examples, the graphical representation is a representation dissimilar to the pattern of locations on the bingo card representation that produced the result.

A gaming apparatus according to the invention is implemented using a number of different processing devices and related hardware operating under the control of operational software. One preferred implementation includes a gaming establishment component that includes a back office system and a gaming floor system. The gaming floor system includes a number of player stations, each having a display for displaying results of the bingo-type game according to the invention. The gaming establishment component either receives bingo designation sets from an external component or generates such sets itself for use in the bingo-type games played through the system. A suitable card processing device included in the gaming establishment component matches the bingo game designation sets to the set of bingo card representations preferably before the card representations are assigned to players for a bingo-type game. Pre-matching the card representations and bingo game designation sets produces a set of game play records that may be stored and then distributed to players as the players request to play the bingo-type game.

The gaming establishment component preferably includes a cashless gaming system, although cash-based systems and cash equivalent systems may be employed according to the invention. In the preferred cashless gaming system, a player places wagers electronically at a player station included in the gaming floor system, and receives results of the wager electronically as well. Accounting for the preferred cashless system is managed through the back office portion of the gaming establishment component.

The gaming apparatus and method according to the invention allow the results of each wager to be displayed quickly and in a variety of fashions or formats. The game may be played like any bingo-type game with the graphical representation of the card being displayed at the player station. However, in addition to, or alternatively to, any bingo-related display at the player station, the player station provides the desired style of result representation including graphics unrelated to the underlying bingo-type game. Yet, the underlying game remains a bingo-type game, that is, a game having the essential characteristics of a bingo game as described above.

It will be noted that the invention is not limited to any particular type of bingo card or bingo card representation. Also, the bingo game designations may be numbers, letters, combinations of characters, or any other suitable identifiable indicia. It should be noted further that when referring to a quantity of items, the term "number" is used in this disclosure and the accompanying claims to mean some quantity more than one such item unless otherwise indicated.

These and other objects, advantages, and features of the invention will be apparent from the following description of the preferred embodiments, considered along with the accompanying drawings.

BRIEF DESCRIPTION OF THE DRAWINGS

FIG. 5 is a representation of a game card used in the present invention.

FIG. 6 is a chart showing a prize schedule which may be used according to the invention.

DESCRIPTION OF PREFERRED EMBODIMENTS

Figure 1:
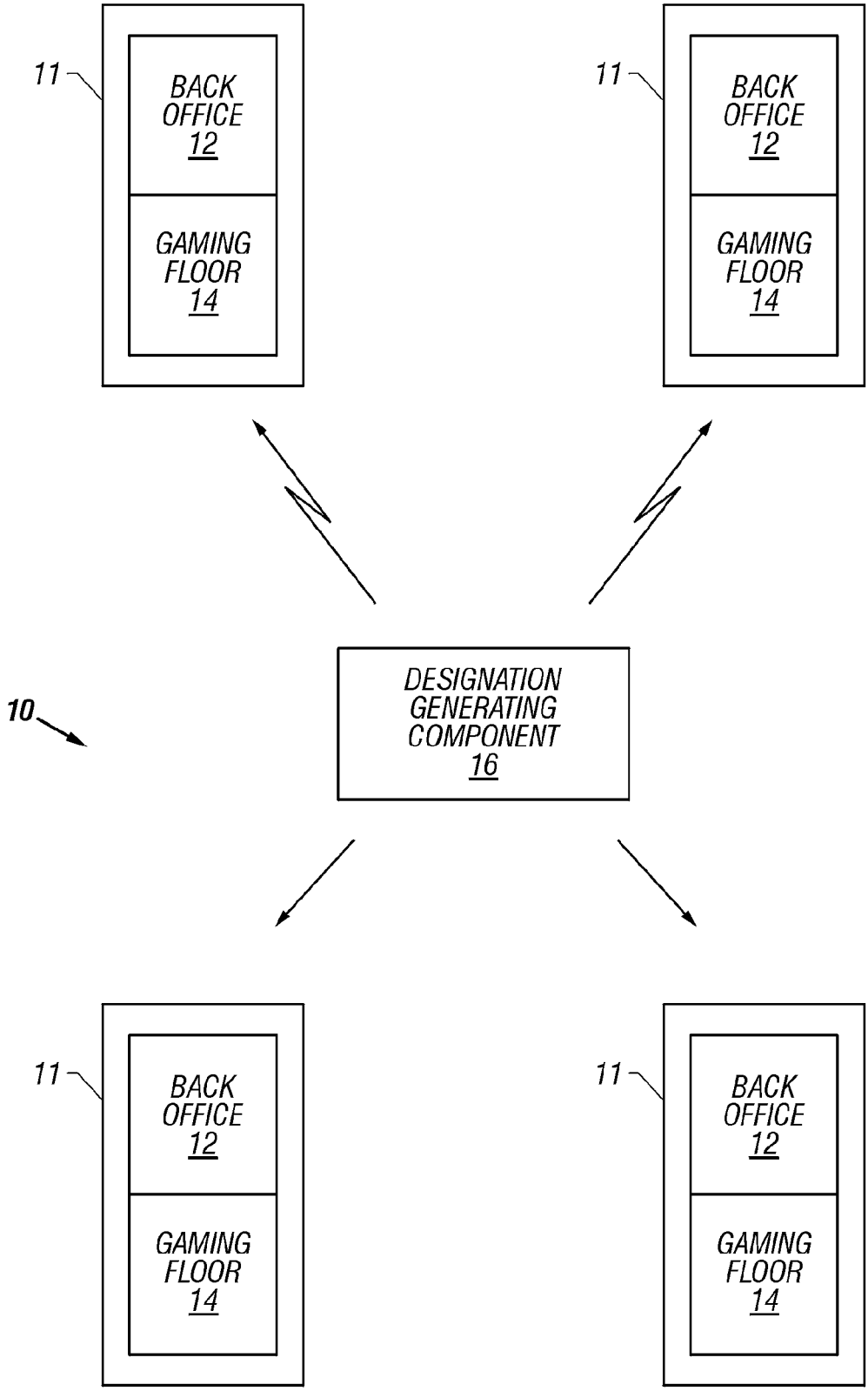
FIG. 1 is a diagrammatic representation of a gaming system embodying the principles of the invention.

Referring to FIG. 1, a gaming system 10 embodying the principles of the invention includes at least one and preferably many gaming establishment components 11, each having a back office system 12 and a gaming floor or casino floor system 14. Gaming system 10 also includes a designation generating component 16 in communication with each gaming establishment component 11. Gaming floor system 14 is accessible to the public and allows players to establish and modify accounts in gaming system 10. Players also use gaming floor system 14 to participate in various games available through gaming system 10. Back office system 12 maintains accounts and account balances for players, maintains account information, and provides system usage reports and other reports useful in managing gaming activities at the particular gaming establishment component 11. Each back office system 12 also matches electronic bingo cards (bingo card representations) to sets of game designations, preferably stores the matched card sets, and assigns the game play records from the matched card sets in response to player requests made through the respective gaming floor system 14.

For each game played according to the invention, designation generating component 16 produces a series or set of game designations, hereinafter referred to as a game designation set, and communicates the game designation set to the various gaming establishment components 11. In one preferred form of the invention, designation generating component 16 includes an automated ball draw system which automatically draws a desired number of balls or other objects from a group of such objects. Each object is associated with a designation so that the series of objects drawn by the device identifies or defines a game designation set. Alternatively to the object draw device, designation generating component 16 may comprise any suitable arrangement for generating designations at random from a pool of available designations to produce the desired game designation set. Regardless of how the game designation set is produced, the resulting designation set is communicated to the gaming establishment components 11. A secure communications arrangement is used to provide communications from designation generating component 16 to the various gaming establishment components 11.

Figure 2:
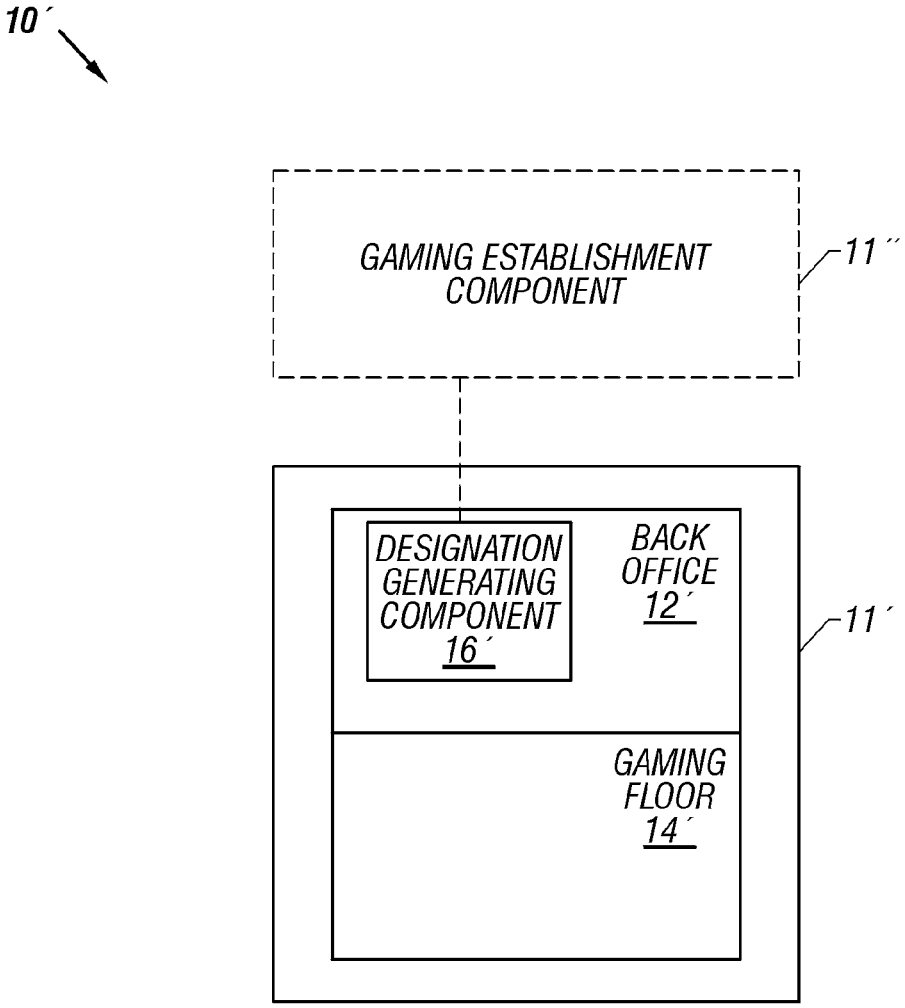
FIG. 2 is a diagrammatic representation of an alternate gaming system embodying the principles of the invention.

FIG. 2 shows an alternate gaming system embodiment 10'. In this form of the invention, designation generating component 16' is dedicated to a single gaming establishment component 11'. In particular, designation generating component 16' is implemented as part of the back office system 12' for gaming establishment component 11'. As a further alternative arrangement, designation generating component 16' may be connected to communicate sets of game designations not only to the local gaming establishment component 11', but also to another gaming establishment component 11" shown in dashed lines in FIG. 2.

Figure 3:
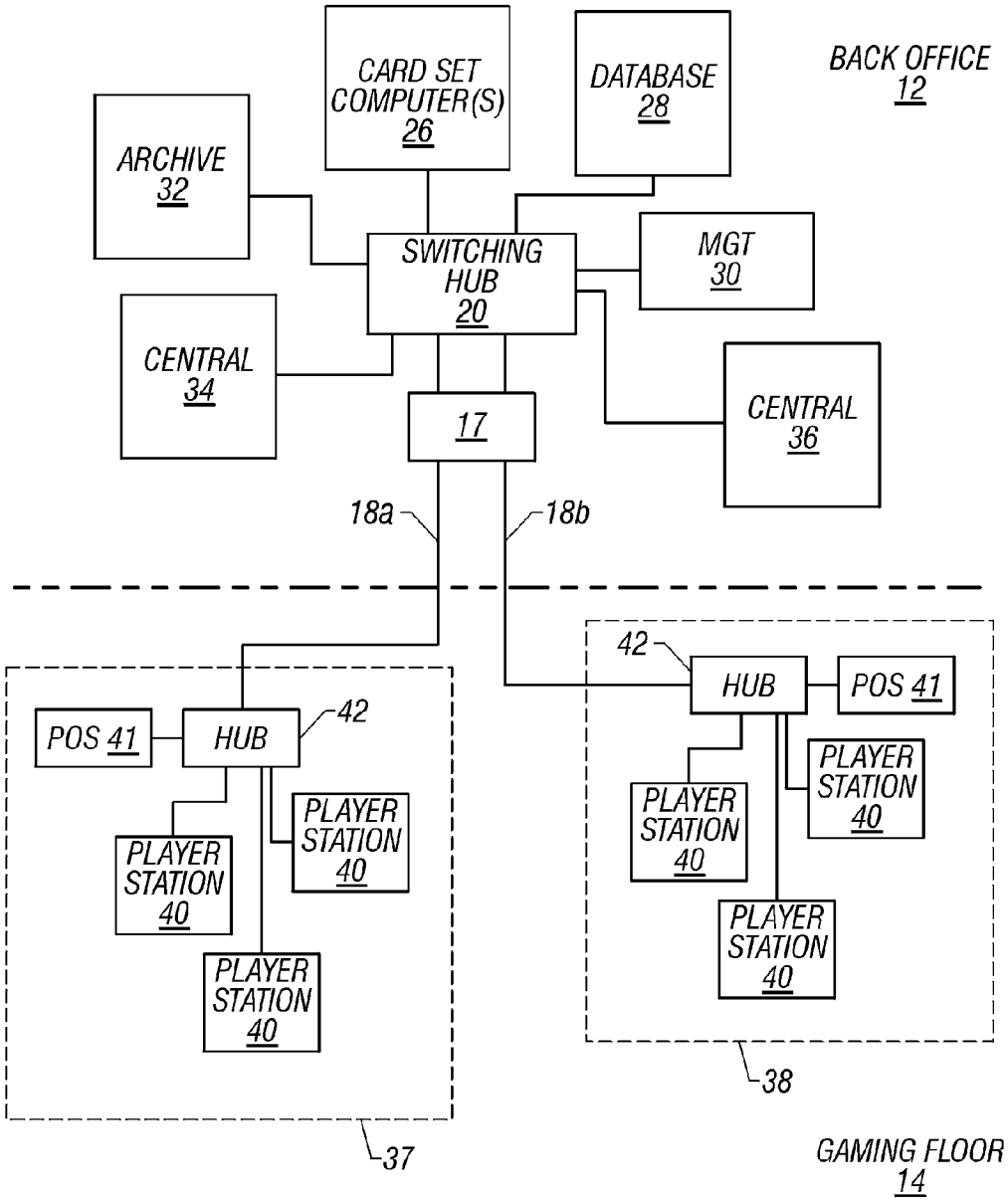
FIG. 3 is a diagrammatic representation of a gaming establishment component according to one form of the present invention.

FIG. 3 shows further detail of a single gaming establishment component 11. As shown in FIG. 3, a secure communications arrangement facilitates communications between back office system 12 and gaming floor system 14. Security may be enhanced with hardware firewalls 17 connected in the communications lines 18*a* and 18*b* that extend to gaming floor system 14 and/or by firewall software operating on the various computers that make up back office system 12.

Back office system 12 includes a number of separate processing devices interconnected through a suitable communications arrangement. In the illustrated form of the invention, back office system 12 comprises a local area network of individual processing devices and includes a switching hub 20 to which each separate processing device connects. The two floor system communication links 18*a* and 18*b* also connect into switching hub 20. Although other types of computer network communications hubs may be used within the scope of the invention, a switching hub is preferred to allow the various system components to communicate simultaneously with fewer conflicts, and thus with increased overall system performance.

The illustrated preferred form of back office system 12 shown in FIG. 3 includes one or more card set computers 26, a database computer 28, a management computer 30, an archive computer 32, and two separate central computers 34 and 36. Card set computer 26, which may also be referred to as a card processing system, matches bingo card representations to game designation sets for different bingo-type games. In the preferred system, card set computer 26 not only matches or daubs card representations but also produces and stores one or more matched card sets, each matched card set including a number of game play records. Each game play record corresponds to an individual bingo card representation in a set of bingo card representations used in creating the matched card sets. The matched card sets, or rather, data representing the matched card sets, are stored in a suitable storage device associated with card set computer 26 until a new or unused set is requested by one of the central computers 34 or 36. At that time, at least one of the matched card sets is communicated to the requesting central computer. Card set computer 26 may also be used to manufacture the set of bingo card representations to be used in the system. Alternatively, a set or perm of bingo card representations may be generated elsewhere and stored in card set computer 26 to be used in producing the desired matched card sets. It will be noted that the invention requires only a single set of bingo card representations to be used in creating numerous matched card sets; however, different sets of bingo card representations may be used to create matched card sets within the scope of the present invention. The structure of the individual bingo card representations will be discussed further below with reference to FIG. 5 and the structure of the matched card sets and game play records will be discussed below with reference to FIG. 11.

In the preferred form of the invention shown in FIG. 3, card set computer 26 may also control a local object draw device or other game designation generating device (such as device 16' shown in FIG. 2) and receive game designation sets from that device. Where software code is executed to generate the required game designation sets, the game designation generation code may be executed by card set computer 26. As a further alternative, the object draw or other device may include its own dedicated controller or processor which supplies game designation sets to card set computer 26. In the implementation of the invention shown in FIG. 1, card set computer 26 may receive game designation sets from the remote game designation generating component (16 in FIG. 1) through any suitable communications arrangement.

Each central computer 34 and 36 is programmed to communicate with card set computer 26, database computer 28, and with a particular group of gaming floor devices. FIG. 3 shows two separate groups of gaming floor devices, group 37 and group 38, for purposes of example. Central computer 34 is programmed to communicate with each of the gaming floor devices in group 37, while central computer 36 is programmed to communicate with each of the gaming floor devices in group 38.

Each central computer 34 and 36 stores data representing one or more matched card sets provided from card set computer 26 for use in servicing game play requests from the gaming floor devices as described below. Each central computer also receives information from the various gaming floor devices in the respective group. Some of this information is stored in database computer 28. For example, central computer 34 receives requests from devices in group 37 to open a player account, add funds to a player account, and withdraw funds from a player account. Central computer 34 also receives game play requests from devices in group 37 and sends game play record information to the respective device in the group from which the respective game play request was received.

The multiple central computer arrangement shown in FIG. 3 provides several advantages. First, in the event that one of the central computers 34 or 36 experiences a technical problem that prevents it from operating properly, only a single group of gaming floor devices is affected. Second, the multiple central computer arrangement shown in FIG. 3 is readily scalable to increase or decrease the number of gaming floor devices supported by the system. Furthermore, the multiple central computer arrangement allows faster communications with the gaming floor devices and therefore increases the speed at which a player may play the game or games offered through gaming system 10.

Database computer 28, along with its associated data storage device or devices, serves as a data storage repository for storing all player records and system usage information. Most importantly, database computer 28 stores in its associated data storage a player account table having entries corresponding to the various player accounts. The player account information includes, for example, the player's name, the player's account identifier or number, in some cases a personal identification number (PIN) for the player, and perhaps other player information personal to the particular player. Database computer 28 may also collect and store usage information indicating the gaming floor devices players have used, and the extent of use.

Numerous different database structures for use in database computer 28 will be apparent to those of ordinary skill in database development and application. The invention encompasses any suitable database structure for maintaining the player and other information required in the operation of the gaming system 10.

Management computer 30 operates under the control of management software to provide system reports including real-time reports and system usage and performance reports of interest to the system operators, managers, or regulators. The software executed at management computer 30 also may be used to schedule administrative functions required or helpful for the database computer system 28. Management computer 30 may include a suitable display for providing a user interface and for displaying reports and other information. Although not shown in FIG. 3, a printer may also be included in the back office portion of the network or may be connected directly to management computer 30 for printing system reports and usage records.

In the preferred form of the invention, central computers 34 and 36 send used matched card sets back to card set computer 26. Card set computer 26 then periodically sends the used matched card sets to archive computer 32 which serves as a repository for used matched card sets. Archive computer 32 is also preferably used to store a copy of each complete unused matched card set as well. These unused matched card set copies and used matched card sets may be archived or stored in any suitable fashion in a nonvolatile memory or storage device associated with archive computer 32.

Referring now to the gaming floor devices shown in FIG. 3, each group 37 and 38 includes a number of player stations 40 and a point-of-sale or cashier terminal (POS) 41, all connected to a local area network communications hub 42. Although not shown in the figure, each group may also include one or more remote point-of-sale (RPOS) terminals, and one or more kiosks also connected to the communications hub 42. The communications hub 42 of each gaming floor group is connected to switching hub 20 of the back office system 12 through one of the communications lines 18*a* or 18*b*.

Figure 4:
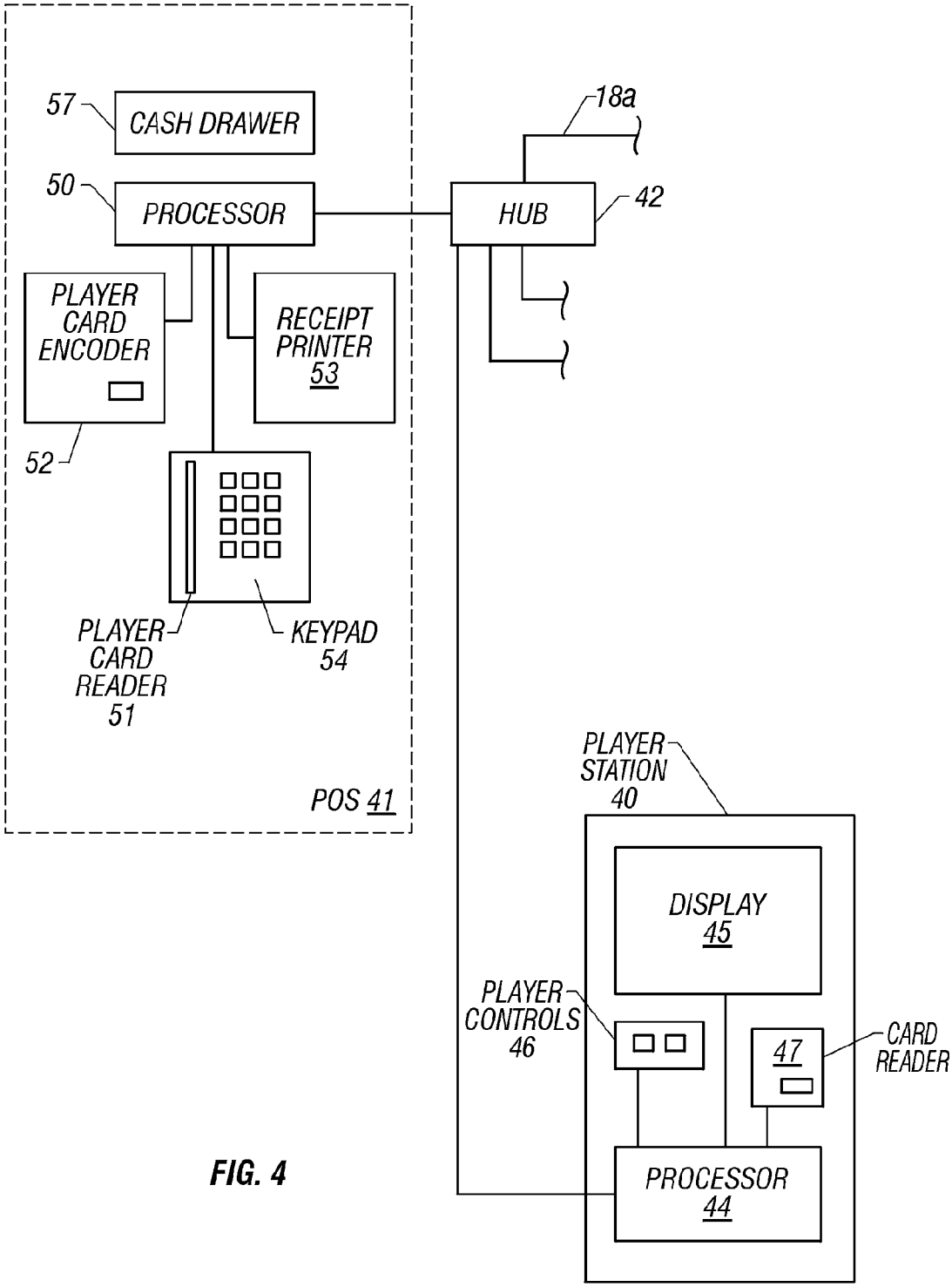
FIG. 4 is a diagrammatic representation of the point-of-sale terminal and player station included in the present gaming system.

As shown in FIG. 4, each player station 40 includes a computer system having a processor 44, a touch screen display 45 or other display capable of displaying different graphical representations under control of processor 44, a control panel 46, and a player card reader 47. Player station software executed by processor 44 receives information from player card reader 47 to log a player into the respective central computer (34 or 36), and then allow the player to participate in the games available through the player station by purchasing pre-matched bingo card representations and corresponding game play records. The player station software also causes display 45 to show a player the results of play as dictated by the purchased bingo card representation/game play record. Further information on the operation of the player stations will be described below with reference to FIG. 9.

It will be appreciated that the player stations may include other hardware depending upon the particular implementation of the gaming system. For example, it may be desirable for a player to add money to his or her account at the player station or simply add money for a wager at the player station. In these instances, player station 40 may also include a token, coin, or bill accepting device not shown in the present drawings, or some other device for accepting some form of payment at the player station. Although the illustrated "cashless" gaming arrangement comprises a preferred implementation for the gaming establishment components 11 shown in FIG. 1, it will be appreciated that the gaming system 10 or 10' is not limited to this preferred "cashless" gaming system or to any other system for interacting with the game players.

The example POS terminal 41 shown in FIG. 4 enables a player to open an account with the gaming system, add funds to his or her account, and close or cash out his or her account. In alternative forms of the invention, POS terminal 41 may allow a player to actually initiate a game play request and receive results in the form of a printed ticket. POS terminal 41 comprises a computer system having a processor 50 and a player/cashier interface including a player card reader 51, player card printer/encoder 52, a receipt printer 53, and keypad 54. POS terminal 41 also includes a cash drawer 57 which is accessible by a POS cashier or attendant. Processor 50 included in POS terminal 41 executes operational software to perform the steps described below with reference to FIG. 8.

Referring now to FIG. 5, each electronic game card or bingo card representation comprises a data structure that defines a grid 60 or other arrangement of designations 63. The illustrated grid 60 may be referred to as a nine-spot grid or card having nine separate locations 61 arranged in a three-by-three pattern. It will be appreciated that the card shown in FIG. 5 is shown only for purposes of example and that the invention is not limited to such a game card or card representation. Five-by-five bingo card representations or any other suitable representations may be used in lieu of the illustrated three-by-three card. For purposes of example only, the separate locations 61 on the illustrated three-by-three card are numbered one through nine by the location identifying numbers 62 appearing in the upper left hand corner of each location. Each game card has a random arrangement of card designations 63 positioned at the various locations 61 of the game card. In the illustrated example, card designations 63 comprise Arabic numerals. The designation residing at location 1 comprises the numeral 8 while the designation residing at game card location 2 is the numeral 6, and so forth as indicated in the illustration. The designations associated with the various locations 61 of the game card are selected from a pool of available designations.

Although the physical three-by-three grid is shown for purposes of illustrating a bingo card representation according to the present gaming system 10, it will be appreciated that the bingo card is actually represented in electronic form for use in the system. The data required to define a given bingo card representation may be arranged in any suitable fashion. For example, the game card may be represented by a series of the nine numerals with the first numeral in the series representing the designation at location 1, the second numeral in the series representing the designation at location 2 and so forth. In this format, the electronic representation for the bingo card shown in FIG. 5 will be a representation comprising series of numbers 8, 6, 1, 3, 4, 7, 5, 9, and 0. Each bingo card representation will also preferably include or be associated with a card identifier or serial number that distinguishes the particular bingo card representation from each other bingo card representation in the set.

It will also be appreciated that the invention is not limited to the illustrated designations comprising Arabic numerals. Any type of designation may be used according to the invention. However, the Arabic numeral designations are preferred because they may be conveniently represented in a digital format for processing with the various data processing devices that implement gaming system 10.

In gaming system 10, players effectively purchase bingo card representations by initiating game play requests through the various player stations 40, and perhaps through POS terminals 41 in some alternative arrangements. Each valid game play request causes a game play record corresponding to a pre-matched bingo card representation to be assigned to the player initiating the game play request. The result associated with that game play record is determined by the pattern in which the game designation set for the particular game match the card designations associated with the corresponding bingo card representation. FIG. 6 shows a payout table or prize schedule for a game that may be implemented through gaming system 10. In this example, the jackpot is won by a player who purchases a bingo card representation (that is, a player who is assigned a game play record corresponding to the card representation) having card designations matched by the game designation set to completely fill in the middle row of the game card. In the example card shown in FIG. 5, the card would be a jackpot winner for the game designation set including the designations 3, 4, and 7.

Operation of the Gaming System

Figure 7:
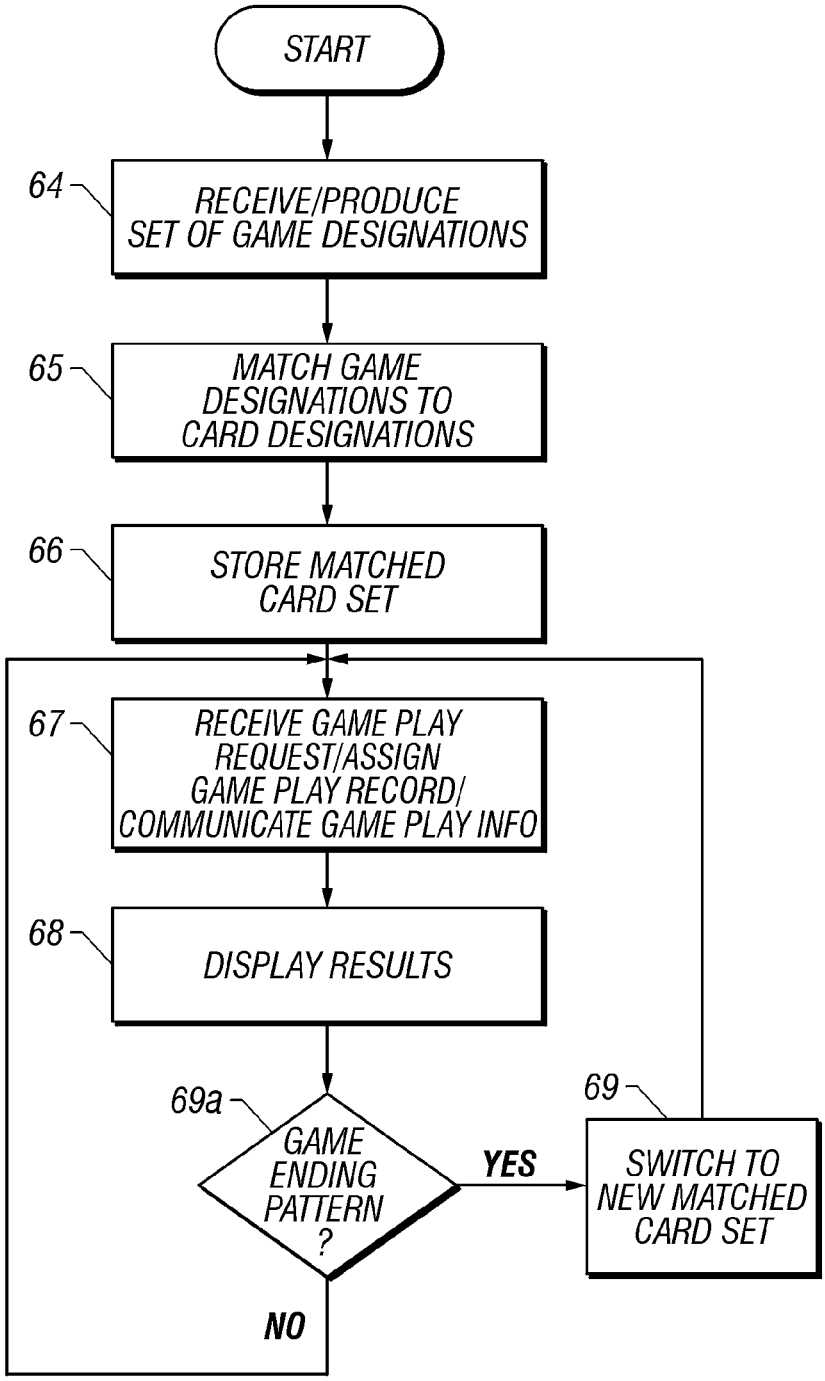
FIG. 7 is a flow chart showing the process steps associated with the overall play of a game according to the gaming system.

Referring to FIG. 7, a gaming method according to the invention includes at process block 64 receiving or generating a game designation set at a gaming establishment component 11 (FIG. 1). The preferred form of the invention then includes matching the game designation set with card designations of the respective bingo card representations as shown at process block 65. This step produces a matched card set which includes a number of game play records. Each game play record corresponds to a different one of the bingo card representations and is associated with a result in the bingo-type game. In the preferred form of the invention, each game play record includes at least a card identifier for the respective bingo card representation, and a result indicator which indicates the result of the game play record, that is, the result of the match between the game designation set and the card designations. The game play record may also include data defining the actual bingo card representation. Details and variations in the game play records will be discussed further below with reference to FIG. 11.

As shown at process block 66 in FIG. 7, the method further includes storing the data representing the matched card set in a suitable data storage device. In the implementation shown in FIGS. 1 and 3, the steps of receiving/generating the game designation set, matching the card designations to produce the matched card set, and storing the data representing the matched card set are all performed by operational program code executed at card set computer 26. In particular, matching program code performs the matching step and game set storage program code performs the storage step. Where card set computer 26 functions as the designation generating device, it also executes a suitable designation generation program which may invoke a random number generating function to generate the desired game designation set. Otherwise, card set computer 26 simply includes some communications arrangement for receiving the game designation set from the remote designation generating device (16 in FIG. 1).

In the preferred form of the invention, the process of receiving a game designation set and producing matched card sets is repeated a number of times at a start of a gaming session to produce a number of matched card sets. The number of matched card sets may be necessary to ensure that the gaming system does not run out of game play records in the course of a gaming session. Also, several different bingo-type games may be in play at any given time in the preferred gaming system, and a different matched card set is required for each different game in play. In fact, each matched card set represents an individual bingo-type game. In one preferred implementation, a player may have a choice of wager level, one credit, two credits, or three credits for example, where each credit is equivalent to some monetary amount. In this case, the different wager levels actually enter the player (that is, represent a game play request) in a different bingo-type game/matched card set. Thus, at least one matched card set must be available for each wager level available in the gaming system.

It will be appreciated that matched card sets may be generated very quickly with current data processing devices and techniques. It may therefore not be necessary to produce and store many different matched card sets for play in the present gaming system. Rather, a matched card set may be produced only as necessary in order to service or respond to play requests initiated by players in the gaming system. In this alternate form of the present invention, the central computer may simply await a game play request by a player, determine if a matched card set is currently available or in play, and if not, generate a new matched card set. The game play request is serviced (a card representation is assigned) from the matched card set that is in play, or if a new matched card set is created, from the new matched card set.

The matched card set storage step 66 in FIG. 7 is performed initially at card set computer 26. However, the preferred form of the invention utilizing central computers 34 and 36 in FIG. 3 also stores matched card sets in storage associated with the central computers. As discussed further below, the game play records are preferably assigned to players directly from the central computers rather than from card set computer 26.

Referring now to process block 67 in FIG. 7, the method also includes assigning game play records from an appropriate matched card set in response to a game play request initiated by a player either at a player station 40 (FIG. 3) or perhaps at a POS terminal 41. In the preferred form of the invention, this assignment step is performed by game play assignment program code executed at the central computer (34 or 36 in FIG. 3) receiving the game play request. As will be discussed further below with reference to FIGS. 9 and 10, a central computer 34, for example, monitors for the receipt of a game play request. If the request is valid, the respective central computer assigns a game play record from the appropriate matched card set to the requesting player as shown at process block 67 in FIG. 7. Sufficient data is then communicated back to the device through which the game play request was initiated to allow the player station to display the appropriate result representation and thereby give the player the results of the game play. This data includes a result indicator which may comprise as much as data sufficient to define the bingo card representation corresponding to the assigned game play record together with the matches made in the matching step 65, or as little as a code for indicating the result. Regardless of the manner in which the game play result is communicated to the player, the method includes the step of displaying the result representation correlated with the game play result to the player as shown at step 68. The manner in which results may be displayed according to the present invention is discussed below with reference to FIGS. 8 and 9.

If the assigned game play record corresponds to a bingo card representation that is not matched in a predetermined game ending pattern, as indicated at decision block 69*a* in FIG. 7, the process loops back to the point above the game play record assignment step (67) and the system waits for the next game play request. However, if the assigned game play record corresponds to a bingo card representation matched in the game ending pattern, the process includes switching to a new bingo-type game represented by a new matched card set as indicated at process block 69. After switching to the new matched card set, the method includes simply waiting for the next game play request. It will be noted that there may be unassigned matched card representations remaining in the matched card set after the game play record corresponding to the card representation having the game ending pattern has been assigned and is held by a player. Any of these unassigned matched card representations or game play records therefore are preferably disregarded by the system and are not used.

When a player opens an account in the preferred "cashless" gaming system 10, his or her account is associated with an account identifier or number. This assigned identifier is then used as an identification element to access the account later. The player also preferably receives a player card encoded with the particular identification element in a suitable machine readable fashion. The player may also be required to set a personal identification number (PIN) for his or her account which must be used in conjunction with the identification element in order to access the player's account, at least for certain purposes. Player information including the player's name, account identifier, and PIN are stored in back office system 12, and specifically in a player account table stored in a data storage device associated with database computer 28 (FIG. 3). The player's account identifier is encoded on the player card so that account access may be initiated by swiping the card through an appropriate reader such as the player station card reader 47 shown in FIG. 4. Alternatively, account access may preferably be initiated by keying in the player account identifier through a suitable system interface. If the player has sufficient funds in his or her account with gaming system 10, he or she may purchase one or more game play records/pre-matched bingo card representations at the various player stations 40 (FIGS. 3 and 4) as will be described in detail below.

Figure 8:
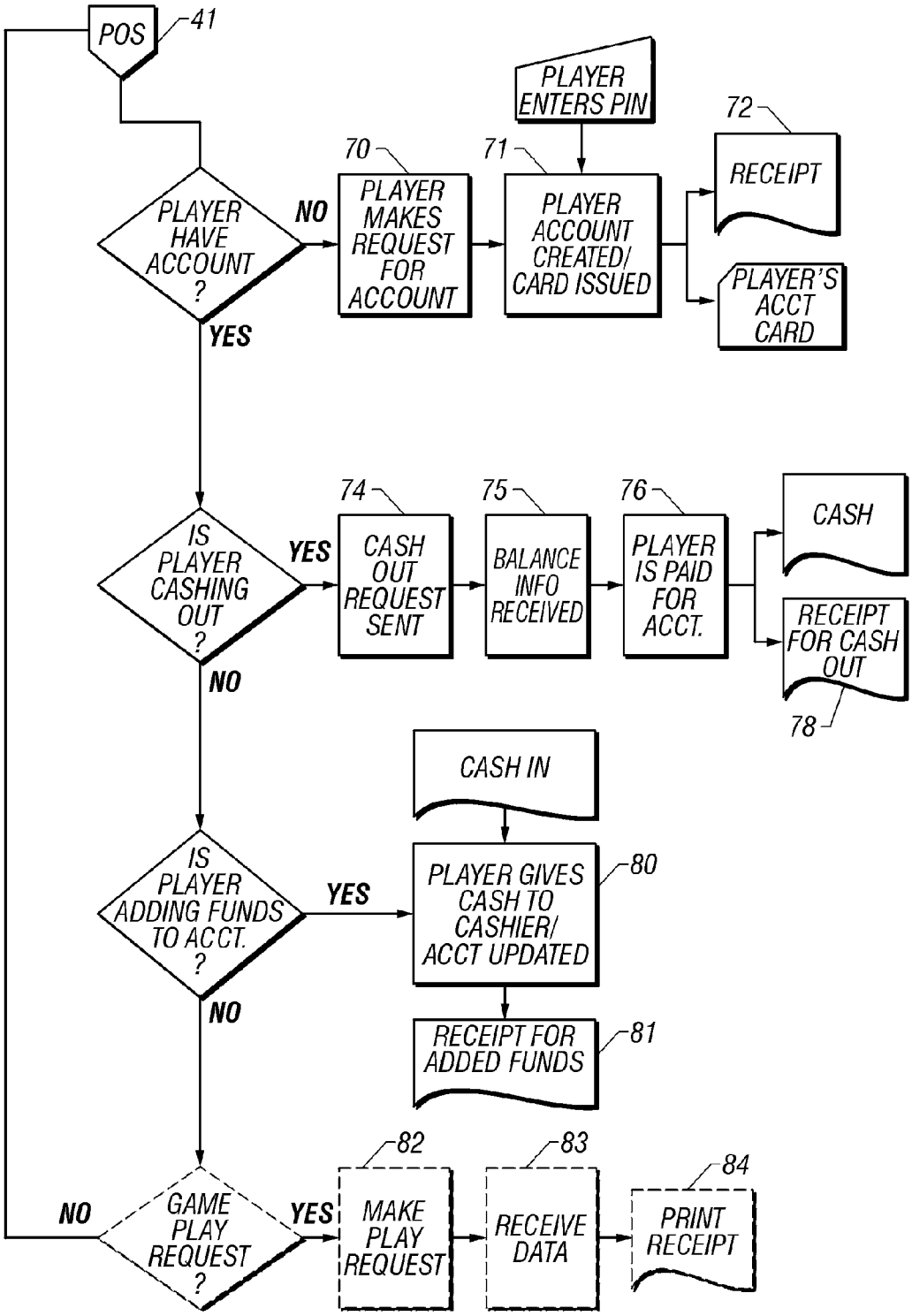
FIG. 8 is a flow chart showing process steps associated with the operation of the point-of-sale terminals.
Figure 9:
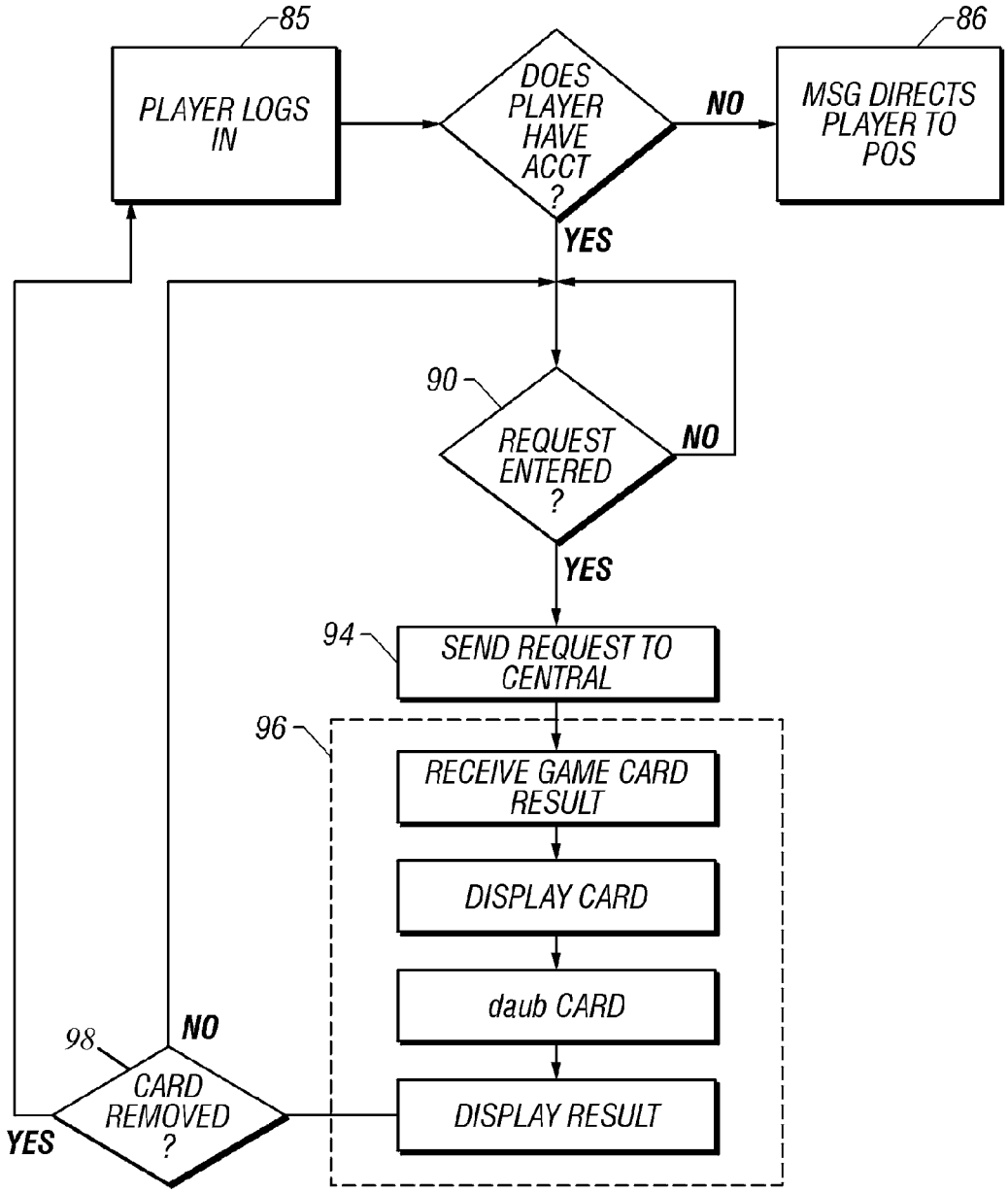
FIG. 9 is a flow chart showing process steps associated with the operation of the player stations.
Figure 10:
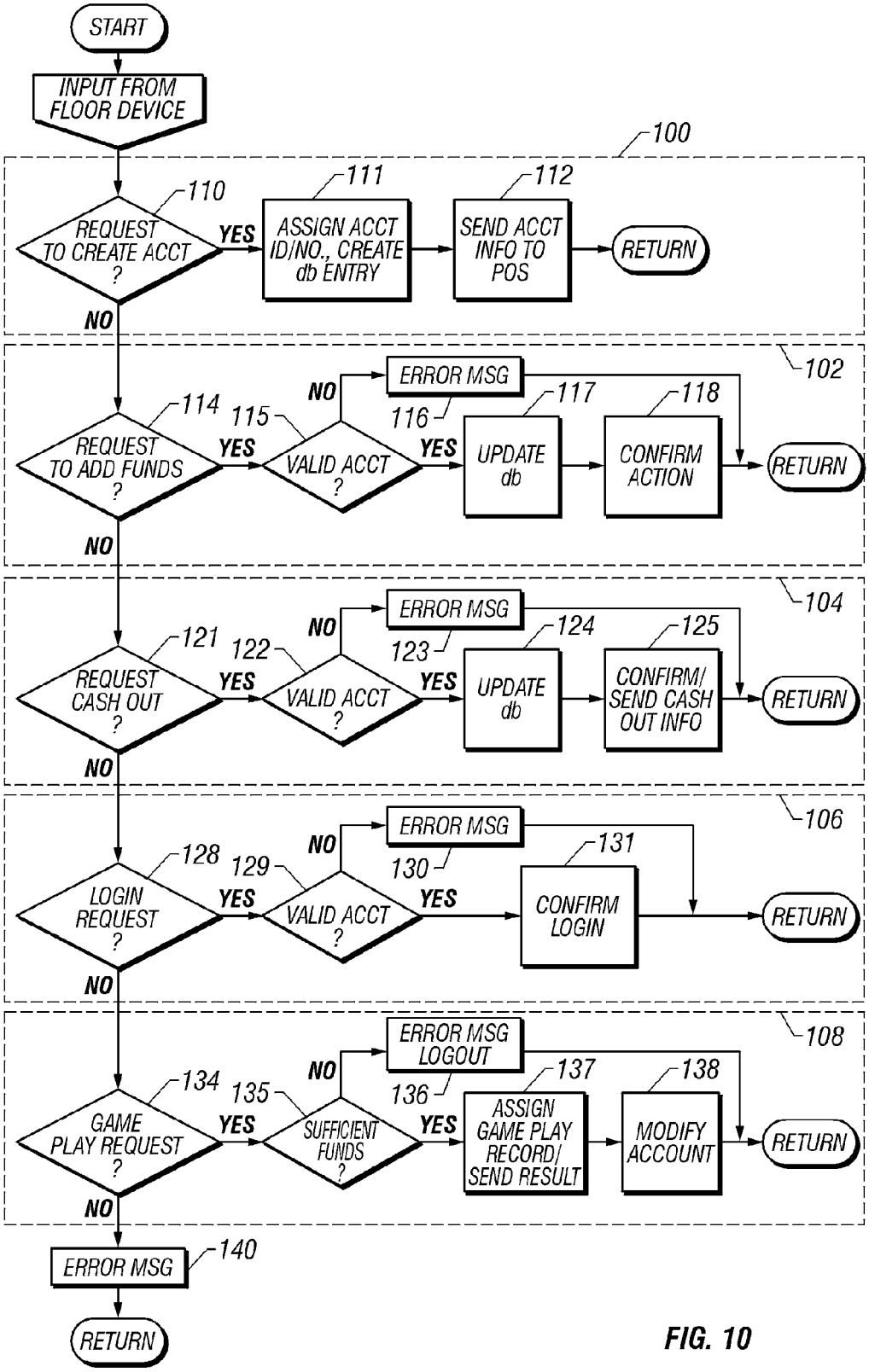
FIG. 10 is a flow chart showing process steps at the central computers.

FIGS. 8 and 9 illustrate the processes performed at the gaming floor devices shown in FIGS. 3 and 4, while FIG. 10 illustrates the processes performed at a central computer 34 or 36 shown in FIG. 3. In the preferred implementation of the invention shown in FIG. 3, each of the gaming floor devices cooperate with a particular central computer, and thus it is necessary to refer to a particular central computer when describing the game floor device processes. For purposes of example, all of the processes described with reference to FIGS. 8 and 9 will refer specifically to central computer 34; however, it will be appreciated that the other central computers cooperate with their respective gaming floor devices in the same fashion. Similarly, FIG. 10 will be described with reference to central computer 34 in order to simplify the discussion, although the identical processes are performed by each central computer in the system.

FIG. 8 illustrates the various processes performed at the POS terminals 41 shown in FIGS. 3 and 4. The primary functions performed through POS terminals 41 include opening a player account, closing or cashing out a player account, or adding funds to a player account. The process of opening an account includes at process block 70 sending an account request from the POS terminal 41 to the associated central computer 34. As will be discussed below with reference to FIG. 10, central computer 34 returns an account identifier which is then encoded onto a player's card at player card printer/encoder 52 (FIG. 4). The player's account card is then issued by the printer/encoder 52. The encoding and issuing step is shown at process block 71 in FIG. 8. The preferred system also prints an account opening receipt as shown at process block 72 using the POS terminal printer 53 (FIG. 4). The player can then use the player card to log in at a player station 40 as will be discussed further below with reference to FIG. 9.

If the player desires to close or cash out his or her account, POS terminal 41 communicates a cash out request to the respective central computer 34 (FIG. 3) as shown at process block 74. The respective central computer responds with a message indicating the player's account balance. Upon receipt of this balance information at process block 75, the cashier at POS terminal 41 may pay a cash balance to the player as indicated at process block 76. POS terminal 41 may also use the data received from the central computer to print a cash out receipt as shown at block 78 using POS terminal receipt printer 53 shown in FIG. 4.

If the player desires to add funds to his or her account at POS terminal 41, the POS terminal communicates the player's account identifier and the amount to be added to central computer 34 as indicated at process block 80. The receiving central computer then updates the player's account information stored at database computer 28 (FIG. 3). As shown at block 81, POS terminal printer 53 (FIG. 4) may print a receipt for the player indicating the amount added to the account and perhaps the account balance after the addition.

In some preferred implementations of the invention, players may initiate game play requests through POS terminals 41 with the aid of the POS terminal attendant or cashier. This optional process is shown at the dashed process blocks at the bottom of FIG. 8. A player initiates a game play request at POS terminal 41 by providing account information to the POS terminal attendant/cashier or entering the information directly as shown at process block 82. With the aid of the attendant/cashier, the player ultimately makes an entry indicating his or her desire for a play in one of the games available through gaming system 10. POS terminal 41 then communicates a game play request to the central computer 34. The complete process performed at central computer 34 in response to the game play request will be described with reference to FIG. 10. The end result of the process for a valid game play request is that the central computer assigns a game play record to the requesting player and communicates information regarding the game play record back to the device from which the game play request was initiated. The receipt of this game play record information is shown at process block 83 in FIG. 8. POS terminal 41 uses this game play record information to print a game play receipt at process block 84 using the POS terminal printer 53 (FIG. 4) or some other printer associated with the POS terminal. The receipt may include a daubed reproduction of the bingo card representation corresponding to the game play record which was assigned to the player.

Referring now to FIG. 9, the preferred process at a player station 40 (FIG. 3) requires a player to log in to the gaming system as shown at block 85 prior to initiating a game play request at the station. In the preferred log-in process, the player inserts his or her player card into the player station card reader 47 (FIG. 4). This causes a communication to the central computer 34 which prompts the central computer to look up the player's account and then return an indicator indicating whether the account is valid or not. If the account is not valid, player station 40 displays a message directing the player to a POS terminal 41 to open an account as shown at process block 86. However, if the player does have a valid account, player station 40 may produce a message indicating that the system is ready for play, and waits for the logged in player to request a play in a game or take some other action. As indicated at decision block 90, if the player requests a play in a game, player station 40 communicates data representing a game play request to the respective central computer at block 94. The game play request data may include a wager amount indicator where different wagers are possible. In the preferred form of the invention different matched card sets are used to service game play requests at different wager levels. Thus, when a player designates a wager level at player station 40, that wager level designates a particular matched card set or type of matched card set stored at the central computer 34. In any event, player station 40 ultimately receives the results associated with the particular game play record assigned to the respective game play request by the central computer, and eventually displays those results as shown at process block 96. If the player's account card is then removed as indicated at decision block 98, the player is logged out of the system and the player station may go to an attract mode. Otherwise, player station 40 simply waits for the player to request another game play.

The manner in which a player requests a game play is dependent upon the particular type of player interface at the player station. Player controls may be included in the display in the form of a touch screen display such as display 45 in FIG. 4. Alternatively or in addition to a touch screen display, various buttons or other user interface devices may be included at the player stations as indicated by controls 46 in FIG. 4. Regardless of the particular player interface, the player operates the player station controls to request a game play, and thereby initiate a game play request communication from the player station to the central computer servicing the player station. The data included in the game play request communication must at least include sufficient data to allow the central computer to identify the matched game set from which the game play request is to be serviced. For example, the data included in a game play request may include a game type identifier which identifies a particular type of matched card set at the central computer 34. The central computer may then use this game type identifier to choose the appropriate matched card set from which to assign a game play record.

The steps involved in receiving and displaying the results associated with a game play record as indicated at process block 96 may vary significantly within the scope of the invention. For example, player station 40 may actually receive the information defining the grid (60 in FIG. 5) and display the grid of designations making up the purchased game card. The information defining the grid of designations comprising the game card may comprise a data structure defining the respective designation at the respective locations on the grid or may comprise simply a serial number that player station 40 may use to look up such a data structure in a database of such structures. This bingo card database may be stored at the player station or elsewhere in the gaming system.

A player at the player station may manually daub his or her bingo card or cards using a touch screen display or some other user interface at the player station. Alternatively, the player stations 40 may include a control that automatically daubs the player's card(s) in response to some automatic daub input entered at the player station.

Alternatively to daubing the card representation at player station 40, the player may rely on the matching of designations performed in the back office system. In this mode of play, the request for a play entered by the player at player station 40 represents a request for automatic daubing. Since no daubing is required at player station 40, the data communicated from the central computer 34 to the player station 40 need only include a result indicator containing information on whether the corresponding bingo card representation produced a winning or losing pattern when matched with the respective game designation set. However, it may be desirable to still send to player station 40 information necessary to allow the station to produce a graphical representation of the respective matched bingo card.

Whether the actual card representation for a play in the bingo-type game is included in the result representation displayed at the player station or is not included in the result representation, the result of the game play, that is, the result associated with the game play record/bingo card representation assigned to the player, may be displayed in any number of fashions unrelated to the bingo-type game. For example, the results may be displayed as spinning reels imitating a slot machine. The spinning reels would stop at a point indicating a win or loss according to the result dictated by the purchased game play record and according to some predefined meaning of reel indicia combinations. That is, the result indicated by the reel indicia showing after the reels have stopped spinning is correlated to the result of the bingo-type game. In this reel-type game or slot machine example, the display of spinning reels at the player station comprises a graphical representation totally dissimilar to the pattern of locations daubed on the underlying bingo card representation.

A specific example in which player station display 45 imitates a reel-type game may be helpful in understanding the present invention. In this example, assume that the card representation assigned to the player in the course of the game comprises a representation of the particular bingo-type game card representation 60 shown in FIG. 5. Also assume that the prize schedule shown in FIG. 6 applies to the particular game. Thus, in this example, the winning game result "jackpot" is associated with the pattern defined by a matched middle row on the card representation, and the winning game result "churn" is associated with the pattern "any two adjacent spots" on the matched card representation. Let us further assume that the result representations through which the game results are displayed include a representation of a reel-type game having three reels. In the present example, assume that the game result "jackpot" correlates to a result representation graphic including all three reels stopped on the indicia "7" and that the game result "churn" correlates to a result representation graphic in which any two reels stop showing the indicia "7" with the third reel stopping at some other indicia.

Using the prize table shown in FIG. 6 and three-reel reel-type game described above, assume the card representation 60 shown in FIG. 5 is assigned to a player and that the entire middle row of card designations are included in the game designation set for the game (that is, the game designation set includes the numerals 3, 4, and 7). Because the card representation assigned to the player matches the game designation set to cover or match the middle row of the card representation, the game result produced or dictated by matched card representation is the "jackpot" result. In the course of game play in this example, player station processor 44 executes display program code to cause display 45 to initially show three spinning reels that eventually each stop showing the indicia "7." Thus, the player station display device 45 displays the result representation including the graphic showing three reels stopped at the indicia "7" and this graphic is correlated to the game result "jackpot." This result in the game is associated with the match pattern in which the designations in the middle row of the card representation are matched by designations included in the game designation set.

As another example using the prize table shown in FIG. 6 and the three-reel reel-type game described above, assume that card representation 60 shown in FIG. 5 is assigned to a player and that only card designations at card locations 7 and 8 are included in the game designation set for the game (that is, the game designation set includes the numerals 5 and 9). Because the card representation assigned to the player matches the game designation set to cover or match two adjacent locations on the card, the game result produced or dictated by matched card representation is the "churn" result. In the course of game play in this example, player station processor 44 executes display program code to cause display 45 to initially show three spinning reels similarly to the previous example. However, because the result of the game play is the "churn" result, and that result is correlated to a graphical display in which two reels stop at "7" and the other reel stops at some other indicia, the display program causes display 45 to show that only two of the reels eventually each stop showing the indicia "7," with the other reel stopping at some other indicia.

It will be appreciated that in this latter example, different graphics may be included in the result representation required to show a particular game result. For example, one graphic to show the "churn" result may show the first two reels stopping at the indicia "7" with the third reel stopping at some other indicia. Alternatively, the result representation correlated to the "churn" result may include a graphic showing the last two reels stopping at the indicia "7" and the first reel stopping at some other indicia. Thus, the invention does not require a unique correspondence between graphic displays and a given result. Rather a given result, such as the "churn" result described above, may be displayed using any one of several alternative graphics.

As other examples, the game play result could be displayed as a horse or dog race having a particular result, or as a result in some other type of casino game such as poker, craps, or roulette, or in any other desired fashion providing a graphical representation unrelated to the game of bingo or dissimilar to the bingo pattern which is associated with the bingo game result. Further alternative result display techniques within the scope of the invention may retain aspects of a traditional bingo game and combine those aspects with other games in some way. In a daubing system in which the player is not required to daub a representation of a bingo card displayed at the player station, the player may not even be aware he or she is playing a bingo-type game.

It will be appreciated that the present method of displaying a result representation correlated to the game result but including a graphical representation unrelated to the bingo-type game, does not require the pre-matching of card representations with a bingo game designation set as performed in the illustrated preferred embodiment. Pre-matching card representations to a bingo game designation set to produce a matched card set is well suited for use with the present graphic presentation of results for a bingo-type game. However, the present method of displaying results in the bingo-type game may be applied to more traditional bingo-type games in which card representations are assigned to players and thereafter matched to a game designation set, either manually by the players or automatically by processing devices. The gaming arrangement in which bingo-type game results are produced by matching or daubing card representations after they are assigned to a player is to be considered equivalent to the pre-matching arrangement for purposes of the following claims relating to the display of game results.

As shown in FIG. 10, central computer 34 is involved in servicing a game play request as well as creating, modifying, and cashing out a player's account. Since a game play request uses a wager to purchase a bingo card representation/game play result, a game play request can in fact be thought of as a particular type of request to modify the player's account. The central computer steps associated with creating an account are shown at dashed box 100 in FIG. 10, while the steps associated with adding funds to an account and cashing out an account are shown in FIG. 10 at dashed boxes 102 and 104, respectively. The central computer steps associated with logging a player in to a player station 40 or other floor device and with servicing a game play request are shown at dashed boxes 106 and 108, respectively in FIG. 10.

As shown at dashed box 100 in FIG. 10, if central computer 34 determines that the received communication is a request to create an account at decision block 110, the central computer cooperates with the database computer 28 to assign a unique account number to the player and to create a new entry for the player in the database controlled by database computer 28 (FIG. 3). This account number assignment and database entry step is shown at process block 111. The new database entry includes an account balance for the player. Information for the beginning account balance may have been communicated from the POS terminal 41 to the central computer along with the request to create a new account or may have been communicated in a separate step. Central computer 34 also communicates the new account information back to the respective POS terminal 41 from which the account creation request was received, as shown at process block 112. As discussed above with reference to FIG. 8, POS terminal 41 uses this information to create a new player card and create a receipt for the player. Where the account is associated with a PIN, central computer 34 also stores the PIN information in the database entry for the player/account and confirms the PIN with the POS terminal. Once the account creation steps are complete, the process returns to START to wait for the next input from a gaming floor device.

If central computer 34 determines that a received communication is a request to add funds to an existing account at decision block 114, the process at the central computer branches to the steps shown in dashed box 102 in FIG. 10. The "add funds" steps include first checking to see if the account information associated with the request is a valid account as shown at decision block 115. If the account is not a valid account, central computer 34 returns an error message to the requesting POS terminal 41 as shown at block 116 and may return to START. The determination indicated at decision block 115 may be made by querying database computer 28 (FIG. 3) to determine if the account identifier corresponds to an open or active account in the account/player database. If this account validation step indicates that the account is valid, central computer 34 updates the entry for the account to add the funds associated with the request as shown at process block 117. Central computer 34 also preferably confirms the execution of the "add funds" request by sending an appropriate confirmation back to the POS terminal 41 from which the request was received. This confirmation step is shown at process block 118. After confirmation, the process returns to START to wait for the next request from a gaming floor device.

If central computer 34 determines that a received communication is a request to cash out an existing account at decision block 121, the process at the central computer branches to the steps shown in dashed box 104 in FIG. 10. Central computer 34 first determines if the account identified in the request is a valid account at decision block 122 similarly to step 115 described above. If the account is not valid, central computer causes an error message to be communicated back to the requesting POS terminal 41 as shown at block 123 and then returns to START. If the account is determined to be a valid account, central computer 34 updates the database by reducing the balance for the account to zero. This account database update step is shown at process block 124 in FIG. 10. After or in conjunction with the database update step, central computer 34 sends cashout information back to the requesting POS terminal as shown at process block 125 to allow the terminal and the cashier at the terminal to take the appropriate action.

Referring now to dashed box 106 in FIG. 10, central computer 34 detects a login request from a player station as shown at decision block 128. In response to the login request, central computer 34 determines if the account is valid as shown at decision block 129 and sends an error message back to the respective player station if the account associated with the login request is invalid as shown at process block 130. If the account is a valid account, central computer 34 communicates confirmation or login information back to the player station 40 to activate the station to accept a game play. This confirmation/login step is shown at process block 131 in FIG. 10. Central computer 34 then waits for the next request from a gaming floor device.

The game play request servicing processes at the central computer 34 are shown generally at dashed box 108. Upon receipt of a game play request as indicated at decision block 134, central computer 34 determines if the player's account has sufficient funds to cover the wager associated with the game play request. This determination is shown at decision block 135 and may be made by querying database computer 28 (FIG. 3) to determine the player's account balance and comparing it to the wager indicated in the game play request. If the player has insufficient funds in his or her account, central computer 34 sends an insufficient funds message back to the respective player station 40 as shown at process block 136. However, if the player has sufficient funds in his or her account to cover the wager associated with the game play request, central computer 34 assigns to the requesting player the next available game play record in the appropriate matched card set as shown at block 137 in FIG. 10. This step may also include the step of communicating the result associated with the game play record to the respective player station. Central computer 34 then modifies the player's account data at database computer 28 by debiting the amount of the wager and adding the amount of any winnings associated with the game play record assigned to the player. This account modification step is shown at block 138 in FIG. 10.

Figure 11:
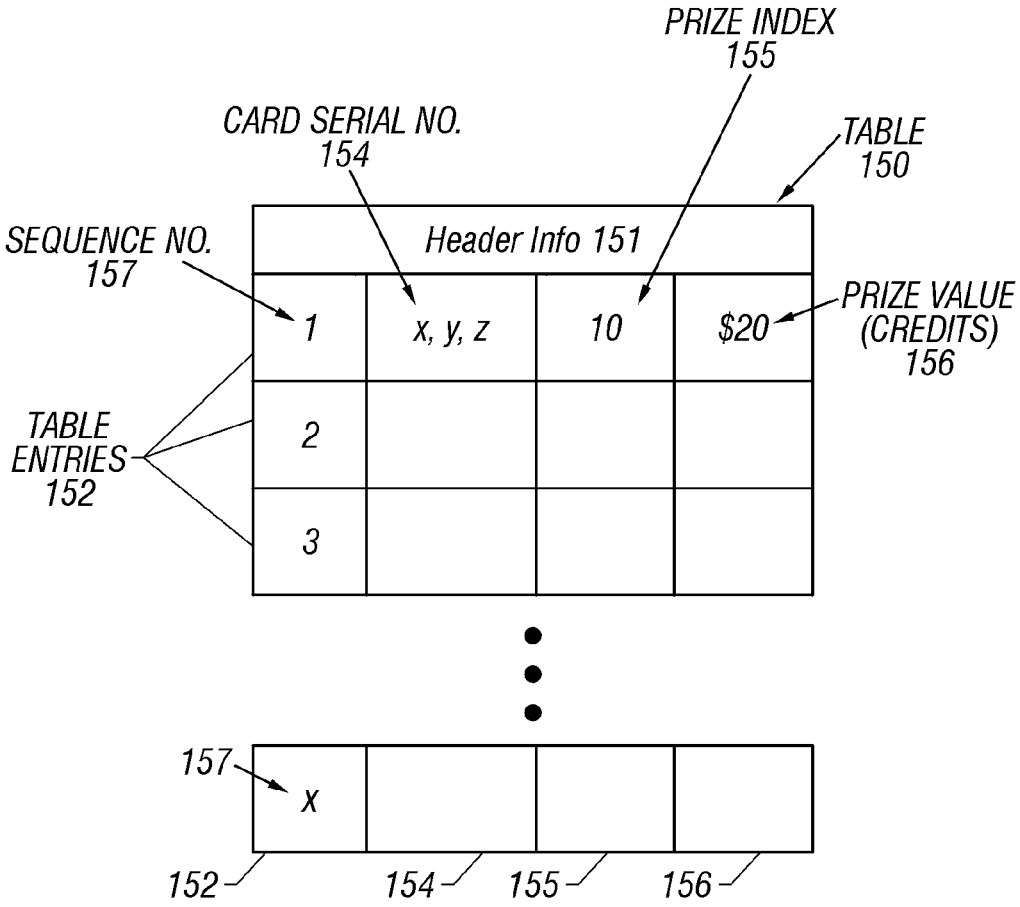
FIG. 11 is a diagrammatic representation of a portion of the data representing a matched card set according to one preferred form of the present invention.

FIG. 11 shows the data representing a matched card set according to one preferred form of the invention. The data is stored in a table 150 including a header 151 identifying the matched card set and distinguishing it from any other card set that is in play or may be created. Header 151 may also include information identifying the matched card set as one to be used for a certain wager level and may further include information identifying or defining the game designation set used to produce the respective matched card set. Table 150 further includes a number of entries 152, each entry representing a respective game play record in the matched card set and corresponding to a different bingo card representation in the set of bingo card representations used to create the matched card set. Each entry 152 includes an ID field 154 containing a card serial number or other card defining information for the respective bingo card representation which corresponds to the entry. Each entry 152 further includes a prize index field 155, prize value field 156, and sequence number field 157. Prize index field 155 contains a value indicating whether the bingo card representation which corresponds to the entry is a winner or loser for the particular game designation set with which the representation is matched, while prize value field 156 contains information indicating the value of any prize for the respective matched card representation and thus the prize value of the game play record. Field 157 contains a value for the sequence in which the respective entry or game play record is to be assigned in the bingo-type game. The entries 152 may be shuffled by card set computer 26 (FIG. 3) preferably before being matched to the respective game designation set in order to randomize the sequence in which the game play records are assigned from the set. In the illustrated form of the invention, the entries are ordered in the set by sequence value. In other forms of the invention, entries may remain in some fixed order but be assigned at random from the set.

A number of these matched card sets each represented by a different data structure such as table 150 are created and stored at card set computer 26 in the preferred gaming system illustrated in FIG. 3. Matched card sets are then transferred to a central computer, such as computer 34, as necessary. The preferred central computers include program code for monitoring its local store of matched card sets and ensuring that requests for additional matched card sets are issued in time to obtain additional sets before running out of records in the currently stored set or sets.

The respective central computer holds one or more of these matched card sets and assigns an entry 152 or information from (or derived from) an entry to a requesting player station (40 in FIG. 3) in response to a game play request received as indicated at process block 66 in FIG. 7. In this preferred form of the invention, the player station 40 may display results according to process block 68 in FIG. 7, by simply displaying the prize value from field 156 or by looking up and displaying a prize value associated with the prize index from index field 155. This latter option requires that the player station 40 or memory accessible to the player station store a table relating prize index values to actual prize values. The graphics displayed to the player in these cases may be related to a traditional bingo game or may be totally unrelated to such a game and instead imitate or portray some other type of game such as a casino game. Also, it should be noted that where game results are shown or dictated by reference to a prize value from field 156 or prize index value from field 155, one of these values is all that must be communicated to the player station in response to a game play request, and the table 150 and entries 152 may be limited accordingly to eliminate the unnecessary field or fields. Alternatively, where the display to be produced at player station 40 is to include the grid making up the bingo card representation corresponding to the respective game play record, the player station may look up the card defining information either from table 150 or from information included in table 150 and display an actual facsimile of the purchased card.

Figure 12:
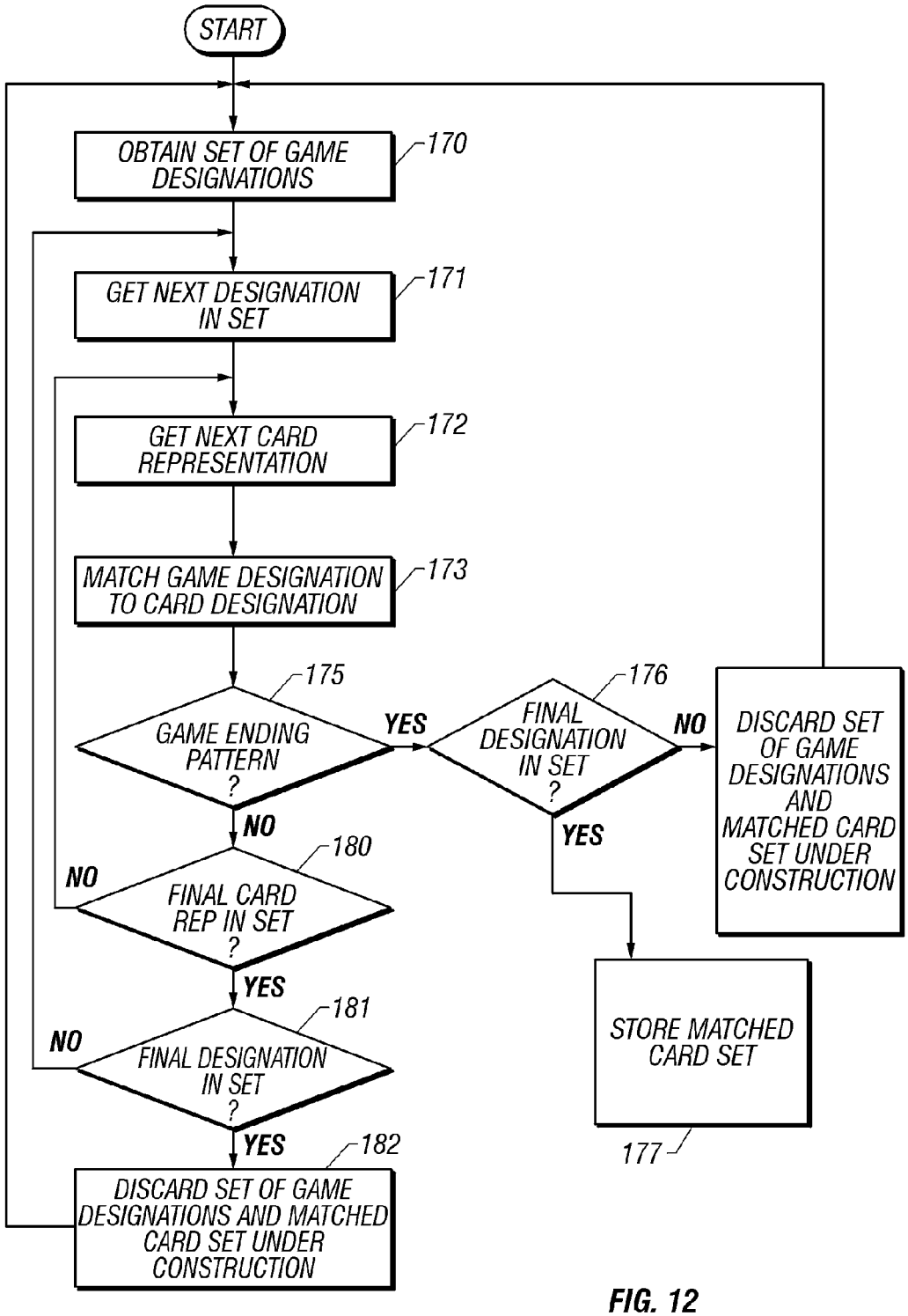
FIG. 12 is a flow chart showing a preferred method for producing matched card sets according to the invention.

FIG. 12 illustrates one preferred process according to the invention for producing matched card sets. As discussed above with reference to FIG. 7, this process is performed by the matching program code preferably executed at card set computer 26 in FIG. 3. Process block 170 shows the step of obtaining a game designation set from a designation generating device such as device 16 in FIG. 1 or 16' in FIG. 2. In the latter case the step may comprise executing the game designation generating program code at card set computer 26. After obtaining the game designation set to be used in the respective game, the process includes selecting the next designation from the game designation set as shown at block 171 and selecting the next bingo card representation from the set of card representations as shown at process block 172. The process then proceeds to the step of matching the selected game designation with the selected card representation as shown at block 173. It will be noted that the sequence of bingo card representations in the set are preferably shuffled prior to the initial step 172 in the process shown in FIG. 12. This shuffling sets the order or sequence in which the game play records are assigned in the play of gaming system 10.

The preferred process for producing matched card sets ensures that the only matched card sets which are stored and used in the system are those in which the game ending pattern is produced in one of the bingo card representations on the final game designation included in the game designation set obtained at block 170. Thus, the process includes a series of decisions to determine if the matched card set being produced meets that criteria. The program code for discarding matched card sets that do not meet the desired criteria may be referred to as matched card set rejection program code.

As shown at decision block 175 the process includes determining if the matching conducted at block 173 produced the applicable game ending pattern in the selected bingo card representation. If so, the process branches to decision block 176 and then includes determining if the currently selected game designation is the final designation in the current game designation set. If not, the process includes discarding the data associated with the matched card set under construction and starting the process over at process block 170. However, if the selected game designation is the final designation in the current set, then the process stores the resulting matched card set for later use by a central computer 34 or 36 in FIG. 3. This storage step is shown at process block 177 in FIG. 12. The process may then begin again to produce an additional matched card set or the process may be terminated if no further matched card sets are then needed.

If the game ending pattern was not indicated at decision block 175, the process branches to decision block 180 to determine whether the selected bingo card representation is the final card in the set. If not, the process returns to the step shown at process block 172 to begin the matching process again with the next bingo card representation in the set. If the card representation is the final one in the set, the process determines whether the selected game designation is the final designation in the current set as shown at decision block 181. At this point the process returns to step 171 if the game designation is not the final one in the current set. However, the fact that the selected game designation is the final one in the current set at this point indicates that the set of bingo card representations will not match with the current game designation set to meet the specified criteria and the data for the matched set under construction is deleted as indicated at process block 182. The process begins again at block 170 unless terminated for some reason.

It will be appreciated that the step of storing the matched card set at process block 177 in FIG. 12 may comprise storing a card set in which some bingo card representations have not been fully matched. Also, in the preferred forms of the invention, no further game play records are assigned after a player holds a game play record corresponding to a card representation matched in the game ending pattern. Thus, any records corresponding to unmatched bingo card representations need not be maintained and may be deleted. The invention preferably includes matched card set truncation program code for deleting out any records ordered or sequenced in the matched card set after the card matched in the game ending pattern.

Figure 13:
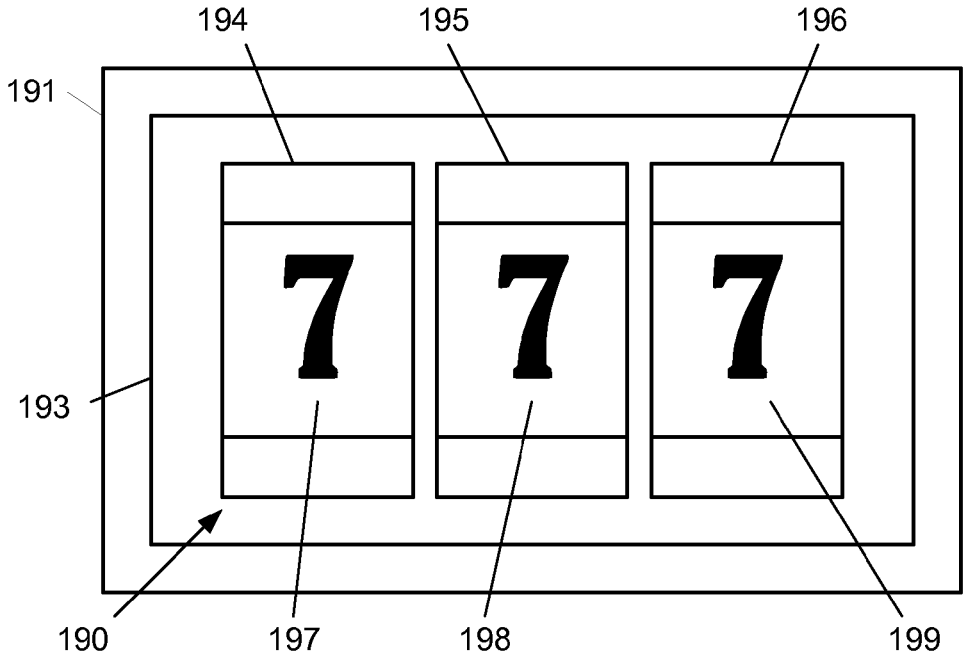
FIG. 13 is a representation of a reel-type display that may be used to show bingo game results according to the present invention.

FIG. 13 shows an example graphical representation 190 imitating a game other than bingo according to the present invention. Graphical representation 190 shown in FIG. 13 comprises a representation of a reel-type game, and is shown on a display device 191 having a display area 193. This display device may correspond to player station display 45 shown in FIG. 4. Graphical representation 190 shows a representation of three reels, 194, 195, and 196, each showing a respective indicia 197, 198, and 199.

Figure 14:
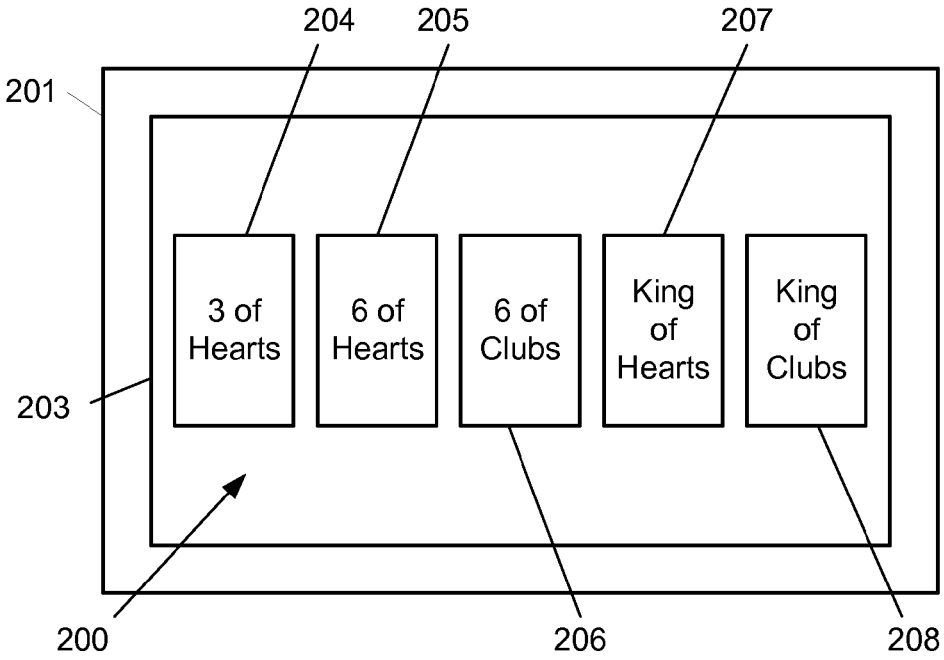
FIG. 14 is a representation of a playing card display that may be used to show bingo game results according to the present invention.

FIG. 14 shows an example graphical representation 200 imitating another game other than bingo according to the present invention. Graphical representation 200 shown in FIG. 14 comprises a representation of a playing card game, particularly a poker hand, and is shown on display device 201 having a display area 203. This display device may correspond to player station display 45 shown in FIG. 4. Graphical representation 200 shows a representation of five playing cards 204, 205, 206, 207, and 208 making up a poker hand.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of" respectively, shall be considered exclusionary transitional phrases, as set forth, with respect to claims, in the United States Patent Office Manual of Patent Examining Procedures (Eighth Edition, August 2001 as revised September 2007), Section 2111.03.

Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention. For example, although a particular hardware arrangement is shown for purposes of describing the invention, it will be appreciated that numerous hardware arrangements are possible for implementing the present invention. Also, although the operational software-controlled process steps are described as occurring at certain processing elements in the system, the processing steps may be distributed in any suitable fashion over various data processing elements.

The invention claimed is:

1. A method for operating a gaming system, the method including:

(a) with a data processing system included in the gaming system, identifying a game ending result for a first bingo card representation included in a group of bingo card representations entered in a bingo game, the game ending result being produced upon matching the first bingo card representation with a game ending number of game designations from a designation draw for the bingo game;

(b) with the data processing system, identifying a bingo game result for at least one other bingo card representation in the group of bingo card representations, the bingo game result for the at least one other bingo card representation comprising an additional winning result defined by a predetermined additional winning pattern of card locations, the additional winning pattern of card locations being dissimilar to the game ending pattern of card locations;

(c) displaying a game ending result representation at an electronic player station in the gaming system for a player associated with the first bingo card representation, the game ending result representation being correlated to the game ending pattern of card locations and including a graphical representation imitating a result in a game other than bingo; and (d) displaying an additional result representation at an electronic player station in the gaming system for a player associated with the at least one other bingo card representation, the additional result representation being correlated to the additional winning pattern of card locations and including a graphical representation imitating an additional result in the game other than bingo, wherein the game other than bingo includes a reel-type game in which a respective result is shown by a number of spinning reels which come to rest to display an array of indicia.

2. The method of claim 1 wherein identifying the game ending result for the first bingo card representation and identifying the bingo game result for the at least one other bingo card representation in the group of bingo card representations are performed prior to an assignment of bingo card representations from the group of bingo card representations to players in the bingo game.

3. The method of claim 1 wherein identifying the game ending result for the first bingo card representation and identifying the bingo game result for the at least one other bingo card representation in the group of bingo card representations are performed after an assignment of bingo card representations from the group of bingo card representations to players in the bingo game.

4. A method for operating a gaming system, the method including:

(a) with a data processing system of the gaming system, identifying a game ending result for a first bingo card representation included in a group of bingo card representations entered in a bingo game, the game ending result including a predetermined game ending pattern of card locations produced upon matching the first bingo card representation with a game ending number of game designations from a designation draw for the bingo game;

(b) with the data processing system, identifying a bingo game result for at least one other bingo card representation in the group of bingo card representations, the bingo game result for the at least one other bingo card representation comprising an additional winning result defined by a predetermined additional winning pattern of card locations, the additional winning pattern of card locations being dissimilar to the game ending pattern of card locations;

(c) displaying a game ending result representation at an electronic player station in the gaming system for a player associated with the first bingo card representation, the game ending result representation being correlated to the game ending pattern of card locations and including a graphical representation imitating a result in a game other than bingo; and (d) displaying an additional result representation at an electronic player station in the gaming system for a player associated with the at least one other bingo card representation, the additional result representation being correlated to the additional winning pattern of card locations and including a graphical representation imitating an additional result in the game other than bingo, wherein the game other than bingo includes a playing card game in which a respective result is portrayed by one or more playing card representations.

5. The method of claim 4 wherein identifying the game ending result for the first bingo card representation and identifying the bingo game result for the at least one other bingo card representation are performed prior to an assignment of bingo card representations from the group of bingo card representations to players in the bingo game.

6. The method of claim 4 wherein identifying the game ending result for the first bingo card representation and identifying the bingo game result for the at least one other bingo card representation are performed prior to an assignment of bingo card representations from the group of bingo card representations to players in the bingo game.

7. The method of claim 4 wherein the game other than bingo is a poker game.

8. A gaming apparatus including:

(a) a data processing system adapted to match a group of bingo card representations with a game designation set for a bingo game to identify a game ending pattern for a first bingo card representation included in the set of bingo card representations and to identify an additional winning pattern for an additional bingo card representation included in the group of bingo card representations, the game ending pattern including a predetermined game ending pattern of card locations produced upon matching the first bingo card representation with a game ending number of game designations from the game designation set for the bingo game, and the additional winning pattern including a predetermined additional winning pattern of card locations matched to the game ending number of game designations from the game designation set, the additional winning pattern of card locations being dissimilar to the game ending pattern of card locations;

(b) a first player station connected for communication with the data processing system;

(c) a first display device associated with the first player station, the first display device for displaying a game ending result representation which is correlated to the game ending pattern and which includes a graphical representation imitating a result in a game other than bingo;

(d) an additional player station connected for communication with the data processing system; and (e) an additional display device associated with the additional player station, the additional display device for displaying an additional result representation which is correlated to the additional winning pattern and which includes a graphical representation imitating an additional result in the game other than bingo, wherein the game other than bingo includes one of (i) a reel-type game in which a respective result is shown by a number of spinable reels, or (ii) a playing card game in which a respective result is shown by a number of playing card representations.

9. The apparatus of claim 8 wherein the back office component matches the group of bingo card representations with the game designation set prior to an assignment of bingo card representations from the group of bingo card representations to players in the bingo game.

10. The apparatus of claim 8 wherein the back office component matches the group of bingo card representations with the game designation set after an assignment of bingo card representations from the group of bingo card representations to players in the bingo game.

11. The apparatus of claim 8 wherein the game other than bingo is a reel-type game having three reels.

12. The apparatus of claim 8 wherein the game other than bingo is a poker game.

* * * * *